United States Patent [19]

Chamberlin

[11] 4,015,645

[45] Apr. 5, 1977

[54] CAN FILLING APPARATUS

[75] Inventor: Donald W. Chamberlin, Los Gatos, Calif.

[73] Assignee: FMC Corporation, San Jose, Calif.

[22] Filed: Mar. 31, 1975

[21] Appl. No.: 563,540

Related U.S. Application Data

[62] Division of Ser. No. 402,431, Oct. 1, 1973, abandoned.

[52] U.S. Cl. ..... 141/34; 141/79; 141/198

[51] Int. Cl.[2] ..... B65B 1/14; B65B 57/06

[58] Field of Search ..... 73/293; 141/1, 78, 94, 141/95, 138, 140, 153, 156, 157, 192, 198, 392, 34, 79, 164, 168–172, 283; 250/222–224, 577; 340/1 L, 251; 356/1, 156, 161

[56] References Cited

UNITED STATES PATENTS

| | | | |
|---|---|---|---|
| 3,217,760 | 11/1965 | Eisenberg | 141/78 X |
| 3,267,287 | 8/1966 | Berthelsen | 250/222 |
| 3,536,925 | 10/1970 | Schmidt | 141/1 X |
| 3,736,057 | 5/1973 | Harvey | 356/1 X |

*Primary Examiner*—Richard E. Aegerter
*Assistant Examiner*—Frederick A. Schmidt
*Attorney, Agent, or Firm*—R. S. Kelly; C. E. Tripp

[57] ABSTRACT

An optical apparatus for determining the level of the contents in a container using a reflected light beam that sweeps across two adjacent photocells while the container is being filled. The light beam is reflected from the surface of the contents in the container so that as the level of the contents varies the reflected light beam correspondingly travels from one photocell to the other. The photocells are electrically connected in opposed relationship and the differential output therefrom is arranged to trigger a relay when the level of the contents reaches a predetermined height.

The container is rotated about its vertical axis during filling so that the light reflected from the gradually raising upper surface of the contents is reflected from a rotating annulus of said surface thereby providing more effective detection of the level of a particulate or segmented product in the container.

8 Claims, 5 Drawing Figures

FIG_2
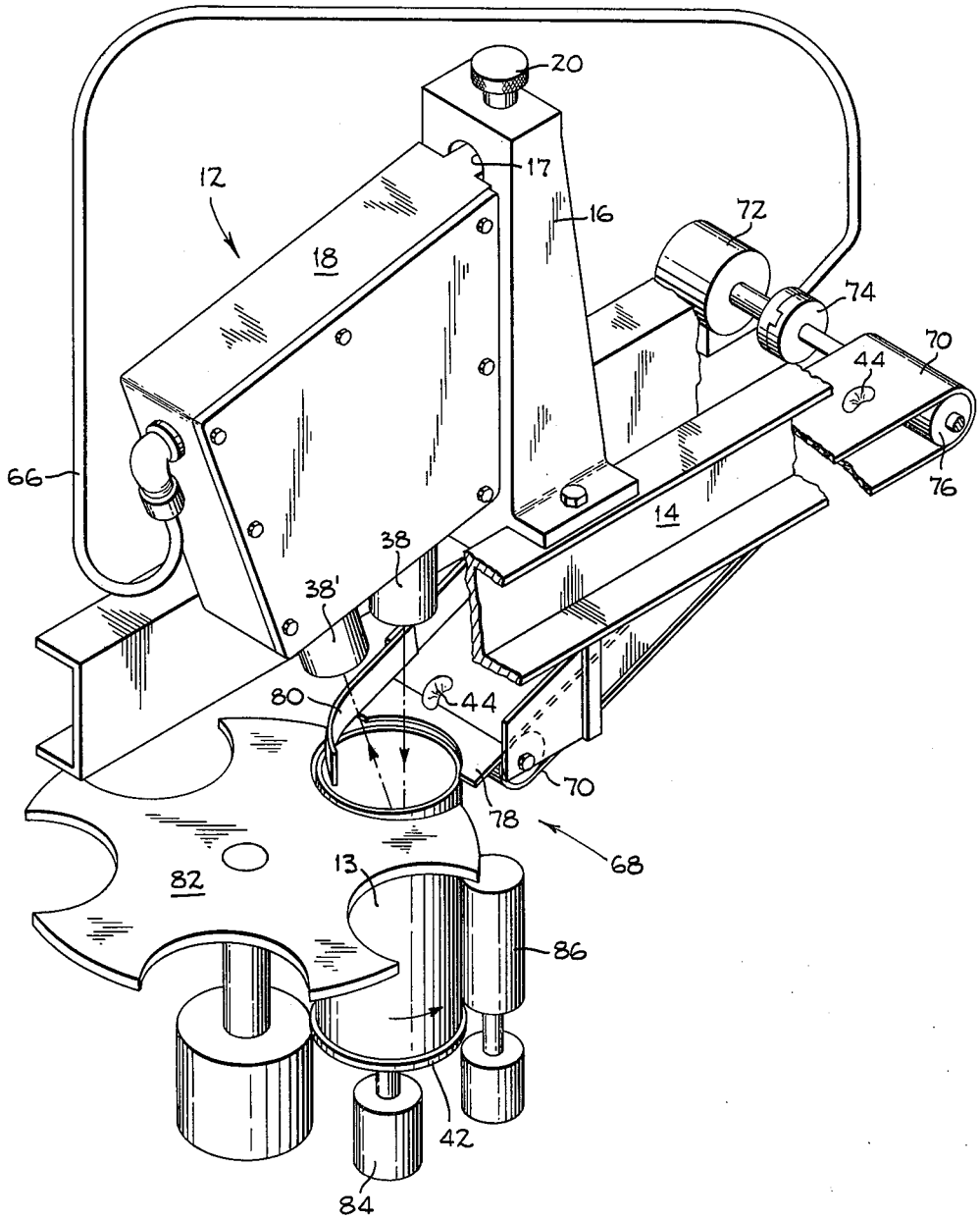
FIG_4
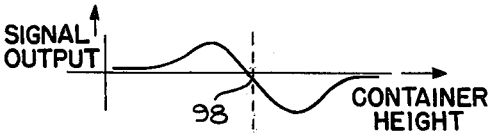
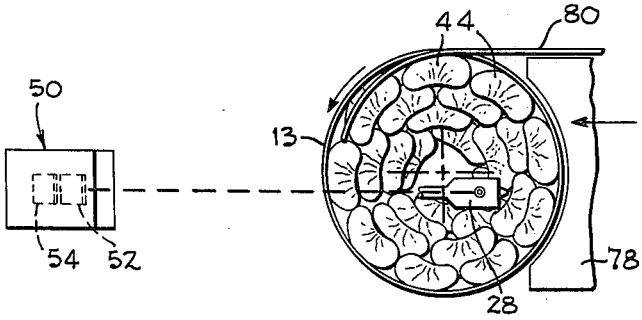
FIG_5

CAN FILLING APPARATUS

This is a division of application Ser. No. 402,431 filed Oct. 1, 1973, now abandoned.

BACKGROUND OF THE INVENTION

1. Field of the Invention

This invention relates to level sensing devices, and more particularly, to devices for determining the level of the contents within containers while the containers are being filled.

2. Description of the Prior Art

In the food processing industry there has long been a need to accurately and dependably fill containers with the proper amount of food. Most commonly a mechanical sensor is used during filling to measure the level of food within the container. These mechanical sensors usually have a foot that extends down into the container and is counterbalanced to lightly touch the top of the food therein. As the container fills, the contents push the foot upward until the foot and its associated linkage trip a microswitch. The actuation of the microswitch indicates that a predetermined level of food in the container has been reached and terminates the filling operation.

One problem with the mechanical sensors is interference with the filling operation. Since the mechanical foot must extend down into the container, very often the foot and its linkage block the mouth of the container and obstruct the entry of food into the container. In addition, the food frequently piles up on the foot and prevents the foot from following the rising level of the contents in the container. When the rising motion of the foot is blocked by the pile of food thereon, the container is filled to overflowing since the microswitch is never actuated.

The problems involved with the use of a mechanical sensor are even more acute when the containers are to be only partially filled at one processing station. Partial filling is usually done at one processing station in order to pack one or more different types of food within the same container at succeeding stations. For partial filling the foot must extend much further down into the container in order to measure the lowest filling level, and, thus, the foot is much more likely to block the entrance to the container during the filling operation.

While optical level detecting devices have been proposed in the past for checking or determining the level of fill in a container, as shown in the issued U.S. patents to Berthelsen No. 3,267,287 and Walker No. 3,404,282 for example, such devices have had only limited utility since they were designed to operate only with liquid materials providing a level highly reflective surface or they were useful only for checking levels at or near the top of the container.

SUMMARY OF THE INVENTION

To determine when the top surface of the contents in a container has reached a predetermined level, the optical level detector of the present invention focuses a light beam upon the top surface of the contents. The light beam is reflected so that as the level of the contents varies the reflected light makes a corresponding angular variation with respect to a fixed receiving lens. The angular variation of the reflected light is tracked by a photodetector means which receives the light from the receiving lens and provides a continuous determination of the angular relationship between the reflected light and the receiving lens. The photodetector means is connected to control means to actuate the appropriate mechanism to stop the filling operation when the predetermined level is achieved.

A major feature of the present invention is the ability to provide a continuous measurement of the relative distance between the apparatus and a reflecting surface. The measurement by the photodetector means is accomplished by electrically connecting a pair of photosensitive elements adjacent to each other and permitting the reflected light from the surface to fall on the photosensitive elements. As the relative distance between the apparatus and the surface varies, the angular relationship of the reflected light with respect to the apparatus changes and the combined output from the two photosensitive elements varies in a predetermined manner thereby permitting tracking of such variation.

Another feature of the present invention is the utilization of the combined output from the photosensitive elements to actuate the control means for stopping the filling as the combined output from the photosensitive elements passes through an electrical null point. The actuation of the control means is thereby triggered by a change in polarity of the output. Thus, the optical level detector does not directly depend upon the magnitude of the output signal for actuation.

An additional feature of the present invention is that it may operate with diffuse reflection from the surface being detected. By using primarily diffuse reflection, the surface being detected need not be as reflective as a mirror nor need it be precisely positioned to provide specular reflection like a mirror. For example, the device of the present invention works well where the material being filled into the containers comprises irregularly shaped pieces of fruit whereas optical level detecting devices of the prior art generally depended upon a level surface at the filling level such as would be provided by a liquid product. Moreover, by taking advantage of the ability of the device to measure diffuse reflection, the photosensitive elements can be located sufficiently far enough away from the surface being detected to avoid undesirable reflections that could produce false output signals. By rotating the container an annulus on the top surface of the contents of the container is detected by the photodetector means, and integrating circuitry can be used to provide an average reading of the level of the contents.

The primary advantage of this invention is the elimination of the mechanical foot that is conventionally inserted into each container during filling with a solid product in order to sense the level of the product in the container. By using a beam of light any interference with or blockage of the product during filling is eliminated.

A further advantage of this invention is that the apparatus is not limited to just measuring the levels of solid food in products in containers. The optical level sensor can be used on any receptacle and with any suitable fluid or particulate material as well as with large solid materials such as fruit segments. The only limitation is that the product whose level is being measured must not be completely transparent to a beam of light and must reflect the light slightly.

BRIEF DESCRIPTION OF THE DRAWINGS

FIG. 2 is a perspective of the optical level detector of the present invention, illustrating, additionally, its use with a fruit conveyor and a container handling machine with certain parts of said latter elements being broken away for the purpose of clarity;

FIG. 4 is a graph illustrating the variation in the combined output from the two photocells in the detector of the present invention as the level of the contents varies in the container; and FIG. 5 is a diagrammatic plan illustrating the geometrical relationships of the light source, the container, and the optical receiving unit of the detector of the present invention.

DESCRIPTION OF THE PREFERRED EMBODIMENT

In general, the optical level detecting apparatus measures the relative distance between the apparatus itself and a reflective surface. The level detector or sensor operates by generating a beam of light that is incident on the surface being measured and then receiving at least a portion of the reflected light back from that surface. As the surface approaches the level sensor, the reflected light is collected and focused upon a pair of photosensitive elements or photocells. The focused light sweeps across the two photocells within the apparatus. The photocells are electrically connected together so that the combined output signals therefrom trigger a relay when the level of the surface reaches a preselected, minimum distance from the level sensor.

In the preferred embodiment, the optical level sensor is used to measure the level of grapefruit sections in a container as the container is being filled. When the preselected level of grapefruit in the container has been achieved, the level sensor stops the filling process and cycles the newly-filled container forward to the next filling operation.

Figure 1:
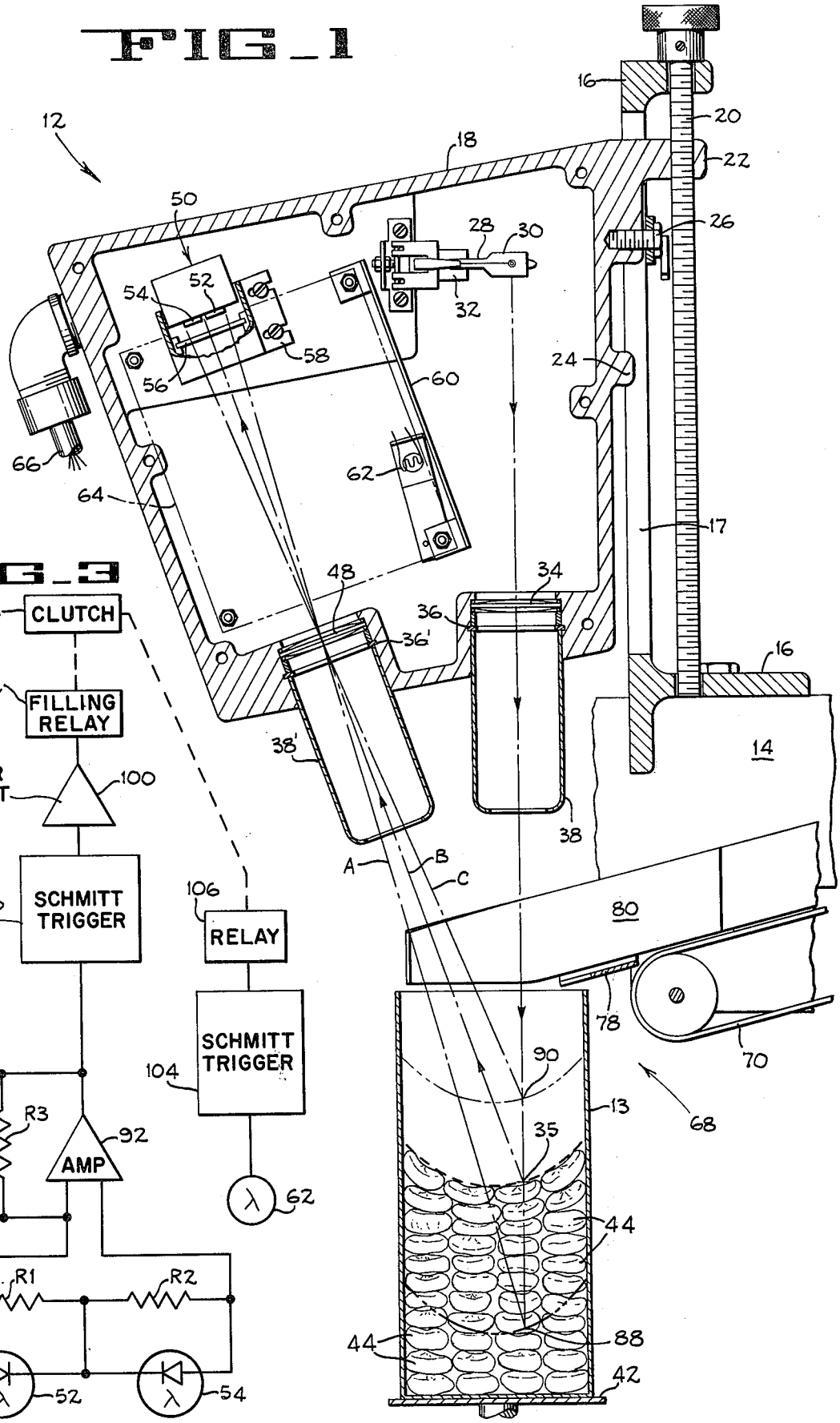
FIG. 1 is a vertical section of the optical level detector of the present invention as used in measuring the level of the contents of a container.

Referring more particularly to the drawings, in FIG. 1 reference numeral 12 generally indicates an optical level sensor that is measuring the level of the grapefruit sections in a container 13. The optical level sensor is mounted on a fixed support 14 by a mounting bracket 16. The mounting bracket has a vertically extending slot 17 that limits the level sensor 12 to vertical motion with respect to the support 14. The level sensor 12 has a housing 18 which is connected to the mounting bracket 16 by an adjusting bolt 20. The adjusting bolt 20 extends in the vertical direction and is threadably received in a projecting ear 22 at the upper end of the housing 18.

As shown in FIG. 1, the optical level sensor 12 is supported from the projecting ear 22 and depends vertically downward therefrom. The housing 18 bears against the mounting bracket 16 with a projecting guide 24 that is received in the slot 17 of the mounting bracket. The guide 24 maintains the vertical alignment of the level sensor and prohibits both horizontal and angular motion. The guide cooperates with the adjusting bolt 20 to permit the level sensor to be vertically adjusted with respect to the support 14 and the container 13. To eliminate any relative motion between the housing 18 and the mounting bracket 16 after vertical adjustment, the housing can be secured to the mounting bracket by a threaded locking bolt 26.

Within the housing 18 of the optical level sensor 12 is located a lamp 28. The lamp is a conventional, horizontally mounted, tungsten-halogen lamp. The lamp has a filament 30 that serves as the origin-reference point for the optical detection system hereinafter described. The lamp 28 is rigidly mounted to the housing 18 by means of a mounting bracket 32. The illumination from the lamp 28 falls upon a transmitting lens 34 that focuses the light vertically downward therefrom. The transmitting lens brings the illumination from the lamp 28 into focus at a focus point 35, i.e., it focuses the image of the filament 30 at point 35. The focus point is set at the level at which the optical level sensor will provide a signal to terminate the filling of the container 13 by means to be hereinafter described. The transmitting lens 34 is a conventional, bi-convex, Pyrex lens located below the filament 30. The transmitting lens is fabricated from Pyrex in order to withstand the high temperatures generated within the housing 18 by the lamp 28. The transmitting lens 34 is firmly anchored to the housing 18 by a snap ring assembly 36 that also provides a water proof seal for the interior of the housing. Rigidly mounted to the housing 18 below the snap ring assembly 36 is a cylindrical sleeve 38. The cylindrical sleeve is a mechanical shield to prevent the grapefruit syrup in the container 13 from splashing upward and soiling the transmitting lens 34. The cylindrical sleeve 38 also prevents other materials, such as the residue from cleaning detergents, from being deposited on the lens.

The container 13 is supported by a platform 42 and is adapted to be filled with grapefruit sections 44. The grapefruit sections in the container provide a slightly reflective, optically diffuse surface. A portion of the illumination from the filament 30 is therefore reflected from the focal point upon the top surface of the grapefruit sections into a receiving lens 48. The receiving lens is a conventional, bi-convex, Pyrex lens of similar construction and focal length as the transmitting lens 34. The receiving lens 48 is rigidly anchored to the housing 18 by a snap ring assembly 36', similar to the assembly 36, which also forms a waterproof seal for the interior of the housing. The receiving lens is also shielded from liquid spray by a cylindrical sleeve 38', similar to the sleeve 38.

The portion of the illumination reflected from the focal point on the surface of the grapefruit sections 44 which is collected by the receiving lens 48 is focused on a receiving unit 50 within the housing 18. Referring to FIG. 1, it will be noted that the receiving unit is angularly displaced about the focus point 35 with respect to the lamp 28 so that the receiving unit does not directly overlie the mouth of the container 13. The receiving unit is comprised of two photosensitive elements or photocells 52 and 54 that are closely mounted side by side with nearly contiguous side margins. The light sensitive faces of the photocells are directed toward the receiving lens 48 as shown. Reference numeral 52 indicates the photocell in the receiving unit 50 that primarily receives the illumination from lamp 28 reflected from the surface of the grapefruit when the level of the grapefruit is below the focus point 35, and referece numeral 54 indicates the photocell that primarily receives the reflected illumination when the level of the grapefruit is above the focus point. For the purpose of the present description, photocell 52 will be termed the "low" cell and photocell 54 will be termed the "high" cell. Photocells 52 and 54 are physically identical in all respects and are photovoltaic cells that generate an output voltage proportional to the intensity of the illumination incident on their light sensitive surfaces.

The receiving unit 50 also includes a red filter 56 in front of the photocells for reducing the ambient blue light coming from any nearby fluorescent lights. For focusing the reflected illumination on the photocells, the receiving unit 50 is attached to the housing 18 by a mounting bracket 58 that permits lateral adjustment of the photocells, i.e., in a plane parallel to the plane of the receiving lens 48, so that the apparatus can be further adjusted to detect different predetermined levels in the container 13.

Within the housing 18 is a light shield 60 for blocking any illumination from the lamp 28 that would ordinarily fall on the receiving unit 50. To further reduce the amount of light reflected within the housing, the interior of the housing is painted a dull, black color. On the side of the light shield 60 away from the lamp 28 is mounted a light monitor 62. The light monitor is a photoconductive cell that has a decreasing electrical resistance as the intensity of the illumination on its sensitive surface increases. The light monitor is mounted so that it extends adjacent to a small narrow opening in the light shield 60 (not shown in the drawings) so as to receive a small portion of the light transmitted therefrom. To verify that the lamp 28 is operating, the light monitor registers the reflection from the lamp 28 passing through the aforesaid narrow opening in the light shield 60. The light monitor is thus utilized to provide an interlock to insure that a triggering signal will always be generated in the electrical circuit, hereinafter described, when the container is filled to the predetermined level. Also mounted within the housing 18 is a circuit board 64 on which the components of the electrical circuit are mounted. These electrical components control the operation of the container filling machine through a plurality of electrical leads indicated by reference numeral 66.

FIG. 2 illustrates the optical level sensor as it is used in controlling a container filling machine. Reference numeral 68 generally indicates a container filling station where the containers 13, already containing syrup, are filled with grapefruit sections. The grapefruit sections 44 are brought to the waiting container 13 by an endless conveyor belt 70. The conveyor belt 70 is powered by an electrically controlled, pneumatic clutch-brake mechanism of conventional construction. The optical level sensor 12 controls the engagement and disenagagement of the clutch through the electrical leads 66. When the clutch is engaged, a motor 72 rotates a belt driving a roller 76 that powers the conveyor belt to bring the grapefruit sections up to the container filling station 68. When the clutch is disengaged, the conveyor belt 70 is braked to an immediate stop, and the container 13 is filled no further with grapefruit sections. At the terminal end of the conveyor belt 70 is a short ramp 78 bridging the gap between the end of the conveyor and the open mouth of the container 13. The container 13 is rotated during filling (in the direction of the arrow) in order to properly position and pack the fruit, and there is a vertical guide 80 positioned at the right hand, terminal end of the conveyor to properly direct the fruit into the rotating container.

The containers 13 are indexed and rotated into the container filling station 68 by a star wheel 82. While at the container filling station, each container 13 is rotated counterclockwise (as viewed in FIG. 5) by an electric motor 84 powering the supporting platform 42. In addition, the containers 13 are held in position during filling by a series of vertical rollers 86 that frictionally engage the vertical side walls of the containers. The vertical rollers, of which only one is illustrated in FIG. 2, also serve to vibrate the containers to more evenly stack the grapefruit sections within each container. In one embodiment of the present invention that was constructed and operated, the platform 42 spun the containers at a speed of about 140 rpm.

The optical arrangement of the level sensor 12 is illustrated in FIGS. 1 and 5. The transmitting lens 34 focuses the illumination from the lamp 28 at the focus point 35. The exact location of the focus point can be calculated from the following equation:

$$1/F = 1/x + 1/y$$

where F is the focal length of the transmitting lens 34,
$x$ is the distance from the filament 30 to the transmitting lens 34, and
$y$ is the distance from the transmitting lens 34 to the focus point 35.

The illumination from the lamp 28 is reflected off of the surface of the grapefruit sections and the syrup, and this reflection will be from a near point source when the level of the contents in the container is at or near the focus point 35, i.e., when the illumination from the lens 34 is focused upon a relatively small area. Since the light is diffusely reflected from the surface of the contents in the container, a portion of the reflected light will always be received by the receiving lens 48 regardless of the particular orientation of the surface upon which the image from lamp 28 is focused. The exact locations of the receiving lens 48 and the receiving unit 50 with respect to the focus point 35 are also determined by the equation hereinbefore given. In other words, the receiving lens 48 focuses the light from focus point 35 upon the receiving unit 50. In one embodiment of the present invention that was constructed and operated, the focal lengths of the transmitting lens 34 and the receiving lens 48 were equal and the distance from the filament 30 to the focus point 35 was equal to the distance from the light sensitive surfaces of the photocells 52 and 54 to the focus point.

The optical character of the surface reflecting the light into the receiving lens 48 is very complex in the case where grapefruit segments are being filled into the containers 13. The illumination coming from the transmitting lens 34 is only brought into precise focus when the level of the container contents is at the focus point 35. When the surface being measured is either above the focus point or below it, the illumination is out of focus and forms an enlarged spot on the surface of the grapefruit. Of course, if the level is near to the focus point 35, the spot of light will still be relatively small and will permit the apparatus to operate effectively. Since the container is spun at high speed during filling, the spot of illumination sweeps out of an annular band on the surface of the grapefruit, and this band is not of uniform elevation where solid segments of grapefruit are being filled. Furthermore, as shown in FIG. 1, the level of the contents in the container slopes downwardly at the center of the container due to the effects of centrifugal force. Moreover, the constant dropping of the fruit sections into the syrup from the end of conveyor belt 70 causes waves and splashes in the surface which further distort the image transmitted therefrom.

To explain the operation of the optics in the level sensor, it will be assumed that the spot of illumination on the surface of the contents provided by lamp 28 is a point source of illumination. This will be the case where the surface is at or near the focus point 35, i.e., where the distance of the surface of the contents from point 35 is small as compared with the distance of the lens 34 from the surface. Some of the light from the point source is directed upwardly so as to fall upon the receiving lens 48. This light is, in turn, focused on the receiving unit 50 as hereinbefore described.

In FIG. 1 three exemplary light rays, A, B, and C are illustrated coming from the point source when the level of the contents is at three different heights. When the level in the container 13 is at a low point indicated by reference numeral 88, the light received by the receiving lens 48 will be focused on the low cell 52 as shown by the ray A which extends through the center of the receiving lens. When the level in the container is coincident with the focus point 35, light reflected therefrom will be focused onto the adjacent edges of the low cell 52 and the high cell 54 as shown by the ray B which extends through the center of the receiving lens. The electrical circuit for the level sensor, as hereinafter described, is arranged to stop the movement of the conveyor belt 70 when the light collected and focused by the receiving lens 48 passes from the low cell 52 to the high cell 54. The circuit is thus conditioned to provide an output signal when the output from the high cell 54 begins to exceed the output from the low cell 52. When the level in the container 13 is filled to a high point indicated by reference numeral 90, the light received by the lens 48 will be focused on the high cell 54 as indicated by the ray C which extends through the center of the receiving lens.

It should be appreciated from the foregoing that the receiving lens 48 acts like the fulcrum of an optical lever formed between the receiving unit 50 and the surface in the container. The effect of the optical lever is to permit the focused rays of light to sweep across the receiving unit 50 as the level in the container varies.

Referring to FIGS. 1 or 5, it will be noted that the transmitting lens 34 does not focus the illumination from lamp 28 directly down on the center of the container 13. The focus point 35, which is in vertical registry with the lamp 28, is located between the center of the container 13 and the ramp 78 at the side of the container and is also laterally displaced away from the center line of the conveyor in a direction away from the vertical guide 80. The focus point 35 is radially displaced away from the center of the container in order to average out the concave surface formed by the grapefruit sections and the syrup being centrifugally forced against the walls of the container during filling. In other words, by locating the focus point away from the low point at the center of the surface being measured, the position of the focus point can be made more representative of the actual predetermined filling level. As a practical matter, the precise radial location of the focus point from the longitudinal axis of the container must be experimentally determined.

In the embodiment of the invention described, the axis of the incident illumination from the transmitting lens 34 is parallel to the longitudinal center line of the container 13. The receiving unit 50 is located substantially forward of the container 13 in a direction away from the conveyor 70 and is laterally displaced (in a direction transverse to the conveyor) from the longitudinal axis of the container at a distance equal to the displacement of the lamp 28 and the focus point 35 from the longitudinal axis of the conveyor, as shown in FIG. 5. The angle formed about the focus point 35 between the filament 30 of the lamp and the two adjacent margins of the photocells 52, 54 is about twenty degrees in the disclosed embodiment of the invention. The angle of twenty degrees is sufficiently narrow so that the level sensor can measure levels of fruit deep within the container without having the reflected beam strike the side wall of the container. The angle is also large enough to avoid any internal reflections from the indentations in the bottom of the container. Obviously other angles can be utilized where different sizes and shapes of containers are to be filled.

The focus point 35 is fixed by the optics of the level sensor. When the housing 18 is either raised or lowered with respect to the mounting bracket 16, the focus point 35 moves upwardly or downwardly with the housing. Thus, in order to fill a container 13 to a predetermined height, the level sensor must be vertically adjusted with respect to the container until the focus point 35 is coincident with the desired level of filling.

Figure 3:
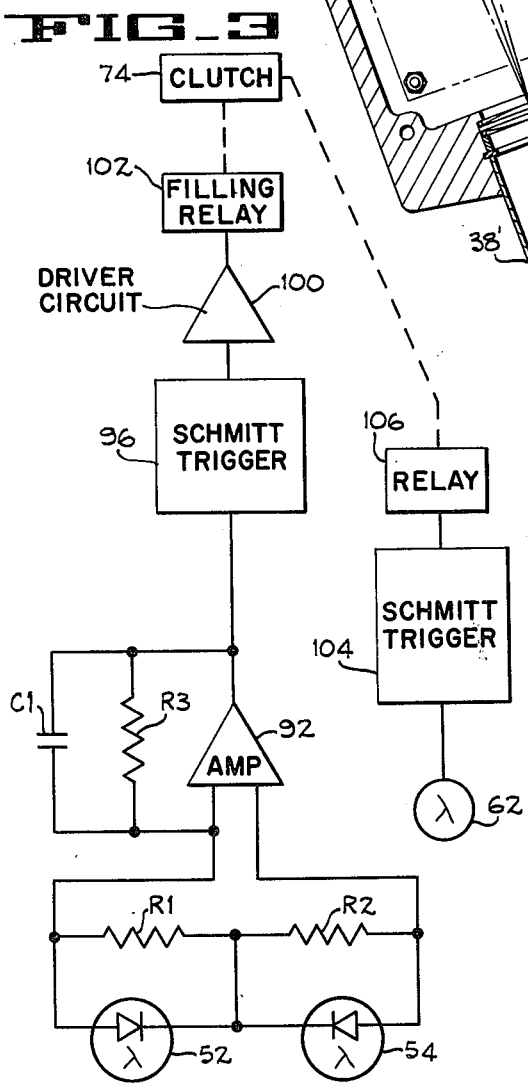
FIG. 3 is an electrical schematic diagram of the control circuit for the optical level detector of the present invention.

FIG. 3 illustrates the schematic diagram for the electrical circuitry of the optical level sensor 12. The low cell 52 and the high cell 54 are serially connected in opposed relationship and are each connected in parallel with a load resistor R1 or R2 so that the photocells operate in a push-pull manner. The combined output from the two photocells and the load resistors is connected to a conventional amplifier 92. A feedback circuit is connected in parallel with the amplifier 92 and comprises a resistor R3 and a capacitor C1. Capacitor C1 and resistor R3 form an integrating filter to provide a smoothing of the output signal. This integrator smooths out the ripple due to the AC light source and also smooths out those variations due to the irregular and rapidly changing reflecting surface as the container is spun. Also, the integrating circuit prevents signals received from reflections off of fruit segments which are falling into the container from providing false level indications.

The output of amplifier 92 is an analog signal indicating the level of the contents in the container. FIG. 4 illustrates this analog signal as the level in the container is varied. Initially, the signal is low because the container level is below the point 88 (FIG. 1) and the reflected rays from the point source of illumination are not focused on the low cell 52. When the level reaches point 88, the signal begins to swing positive over the ambient light level because light is focused upon the edge of the low cell causing the cell to provide a positive output signal. The signal becomes increasingly more positive as more of the reflected light falls on the low cell. As illustrated in FIG. 1 the reflected light rays represented by rays A, B, and C sweep across the photocells from the low cell to the high cell as the level in the container is raised. When some of the light begins to fall on the high cell 54, the combined signal from amplifier 92 begins to decrease because, although the low cell is still receiving most of the illumination, the output from the high cell starts to substract from the output from the low cell. The subtraction process continues until the output from the two cells cancel each other and the combined signal is zero. At this point the focused light, as represented by ray B, is falling squarely between the two cells, and the level of the contents in the container is at the focus point 35. If the container is filled above the focus point 35, the focused rays sweep toward the high cell and the increasing output of the high cell 54 coupled with the decreasing output of the low cell 52 causes the combined signal from amplifier 92 to go negative. The combined signal goes increasingly negative as the contribution from the low cell becomes less and less. Ultimately the signal returns to a low level as the focal point of the rays from the point light source moves off of the high cell.

Continuing with the electrical schematic (FIG. 3), the output of amplifier 92 is connected to a conventional Schmitt trigger circuit 96. The Schmitt trigger circuit is set to provide an output pulse when the output signal (FIG. 4) from the amplifier 92 goes slightly negative and reaches the level indicated by reference numeral 98 (FIG. 4). The output of the Schmitt trigger 96 is connected to a two transistor, driver circuit 100 of conventional construction. The driver circuit drives a filling relay 102 and the filling relay 102 has a contact in the electrical circuit to a conventional clutch-brake mechanism 74 (FIG. 2) controlling the movement of belt conveyor 70. When the filling relay 102 is energized by the Schmitt trigger 96, the clutch-brake mechanism 74 disengages the motor 72 from the belt driving roller 76 of the conveyor and applies a brake, and the grapefruit sections are immediately stopped from being delivered into the container 13. The filling relay 102 is also connected to a control circuit (not shown) controlling the operation of the star wheel 82 (FIG. 2). When the filling relay is energized, the control circuit causes the star wheel to rotate, thereby moving the filled can of grapefruit away from the filling station 68 and inserting an empty can in front of the delivery conveyor 70.

An interlock circuit is used to insure that the lamp 28 remains illuminated during operation. This circuit includes the light monitor 62 (FIGS. 1 and 3) which registers the presence of illumination from the lamp 28. The output of the light monitor circuit is connected to a second Schmitt trigger circuit 104 that is, in turn, connected to a relay 106. The relay 106 has a contact in the circuit (not shown) for engaging the clutch-brake mechanism 74. When the lamp 28 is providing illumination, the Schmitt trigger 104 has an output that energizes the relay 106. When the relay 106 is energized, the contact in the clutch engaging circuit (not shown) is closed, thereby permitting the clutch 74 to couple the motor 72 (FIG. 2) to the belt driving roller 76. The interlock circuit is required to insure that sufficient illumination will be received by the photocells 52,54 from the lamp 28 when the desired level in the container is achieved. If the lamp 28 becomes extinguished, then the high cell 54 will never receive sufficient illumination to cause the Schmitt trigger 96 to provide a pulse output and thereby disengage the clutch 74. In other words, the conveyor 70 (FIG. 2) will not be stopped when the desired level in the container is achieved, and the container will be filled to overflowing.

The overall operation of the optical level sensor 12 will now be described. The optical level sensor is initially brought into vertical alignment with the container platform 42 by using the adjusting bolt 20. As hereinbefore described, the focus point 35 moves with the housing 18 and the preselected filling level within the container 13 is adjusted by vertically moving the housing 18 with respect to the container platform 42.

Initially, the containers are filled to a predetermined level with syrup and are rotated into the container filling station 68 by the star wheel 82. When the star wheel brings a container 13 into position in front of the conveyor 70, a limit switch (not shown) permits the clutch-brake assembly 74 to couple the motor 72 to the belt driving roller 76. The clutch 74 will engage the motor only if the lamp 28 is providing illumination and the output from high cell 54 is not indicating a high level of contents within the container. When the belt conveyor 70 begins to operate, the grapefruit sections 44 are transported on the upper run of the conveyor, across the ramp 78 and into the container 13. In addition to starting the conveyor 70, the movement of the star wheel 82 into position also energizes the motor 84 for the container platform 42.

As the container 13 is filling, the top surface of the grapefruit sections reflects the light beam from the lamp 28 through the receiving lens 48 and onto the receiving unit 50. As described hereinbefore, as the level in the container is increasing, the output signal from the photocells 52 and 54 in the receiving unit varies according to the graph illustrated in FIG. 4. When the level reaches the focus point 35, the output signal has just passed through the zero reference point, where light is falling equally on the high cell and the low cell, and is slightly negative. The Schmitt trigger 96 is then fired to stop the filling operation by energizing the filling relay 102. The filling relay 102 also stops the container platform motor 84, and, in addition, causes the star wheel 82 to rotate the newly filled container out of the container filling station 68 and to rotate a new, empty container into position to be filled. The hereinbefore described container filling sequence is then repeated.

A modified container filling arrangement could be provided by the optical level sensor of the present invention by having the sensor provided by the optical level sensor of the present invention by having the sensor provide an output signal after the output from the amplifier 92 dropped from a high positive value to a low value near zero. This output signal, which would occur just prior to the signal indicating that the container had been filled to the proper level, could be used for slowing the filling operation in order to achieve a more accurate fill.

Although the present invention has been illustrated and described in its preferred embodiment as utilized in the filling of a container with grapefruit segments to a predetermined level, it is not intended to be so limited. The optical level sensor can be used to measure the level of the contents in any suitable container with any suitable material. The level sensor can be used to measure the levels of both liquids and solids in all types of containers as long as the surface which is being detected has sufficient light reflective properties to provide the receiving lens 48 with a detectable light source well above the ambient light level.

The optical level sensor is especially suited for measuring levels deep within containers where physical sensors have heretofore blocked the insertion of material into the containers. In one embodiment of the present invention that was constructed and operated, the optical level sensor was used to measure the insertion of two types of fruit into the same container. The level sensor first measured the deposit of a shallow level of grapefruit sections into the container, and subsequently, the complete filling of the container with orange sections.

The optical level sensor of the present invention is particularly useful for measuring levels in containers having highly reflective, internal surfaces. The optical geometry of the level sensor minimizes the effect of the reflections from the internal sidewalls of the containers and from the rippled, bottom surfaces of the containers.

Although the best mode contemplated for carrying out the present invention has been herein shown and described, it will be apparent that modification and variation may be made without departing from what is regard to the subject matter of the invention.

What is claimed is:

1. Apparatus for filling a container to a predetermined level comprising means for supporting a container having a vertical axis of generation, means for filling said container with a product, means for rotating the container and product about said axis, a light source, a first lens for focusing the light from said light source upon a spot on a rotating annulus that is concentric with said axis and is formed on the top surface of the product in said container, a second lens positioned so as to receive at least a portion of the light reflected from said annulus, a photodetector means having a pair of photosensitive elements positioned directly adjacent to each other in a plane parallel to the plane of said second lens, said photosensitive elements being electrically connected so that an output signal is provided therefrom which is indicative of the relative amounts of light received by each of the elements, said second lens being positioned with respect to said photodetector means and said rotating annulus so that said light reflected from said spot on said annulus is focused on said photodetector means, said photodetector means being capable of providing a continuous measurement of the angle between said lenses about said spot on said rotating annulus to thereby provide continuous measurement of the level of the top surface of the product in said container, and control means connected to said photodetector means and to said means for filling the container for stopping said means for filling the container in response to said output signal when said top surface of the product in said container reaches said predetermined level.

2. Apparatus according to claim 1 wherein said photosensitive elements are photovoltaic elements connected in opposed relationship.

3. Apparatus according to claim 1 including means for detecting the absence of light from said light source, said last named means being connected to said means for filling said container in order to stop the filling of the container if said light source is extinguished.

4. Apparatus according to claim 1 including means for vibrating said container as the container is being filled.

5. Apparatus according to claim 1 wherein said apparatus further includes means for varying the location of said light source, lenses and photodetector with respect to the location of the container to permit the filling of different predetermined levels within the container.

6. Apparatus according to claim 5 wherein said location varying means comprises a housing for said light source, lenses and said photodetector, a mounting bracket, and means for mounting said housing on said bracket for adjustable vertical movement.

7. Apparatus for filling a container to a predetermined level comprising means for supporting a container, means for filling said container with a product, a lamp, a transmitting lens, said transmitting lens directing illumination from the lamp in a direction generally parallel to the longitudinal axis of the container to a spot on the top surface of the product in the container, said spot being radially displaced from the center axis of the container, means for rotating the container so that the spot traverses an annulus on said top surface that is concentric with said axis, a pair of photosensitive elements positioned directly adjacent to each other, said photosensitive elements being electrically connected so that an output signal is provided therefrom which is indicative of the relative amount of light received by each of said photosensitive elements, a receiving lens for receiving illumination reflected from said spot on said rotating annulus and for focusing said reflected illumination on said photosensitive elements, the amount of light focused on each of said photosensitive elements being determined by the level of the spot on the annulus on the top surface of the product in said container, integrating circuitry connected to receive said output signal and to integrate said output signal whereby the output of said integrating circuitry is representative of the average level of the rotating annulus, and control means connected to said integrating circuitry and to said means for filling the container for stopping said means for filling the container when the average level of said top surface of the product in said container reaches said predetermined level.

8. Apparatus according to claim 7 wherein said photosensitive elements are angularly displaced with respect to the lamp about said top surface of said contents so as to be located vertically above a point outside of said container.

* * * * *

UNITED STATES PATENT OFFICE

CERTIFICATE OF CORRECTION

Patent No. 4,015,645 Dated April 5, 1977

Inventor(s) DONALD W. CHAMBERLIN

It is certified that error appears in the above-identified patent and that said Letters Patent are hereby corrected as shown below:

Column 4, line 67, "referece" should be --reference--.

Column 5, line 46, after "sensor" insert --12--.

Column 10, lines 42-44, delete "provided by the optical level sensor of the present invention by having the sensor".

Signed and Sealed this

*Fourth* Day of *December 1979*

[SEAL]

*Attest:*

SIDNEY A. DIAMOND

*Attesting Officer*

*Commissioner of Patents and Trademarks*